US007914000B2

(12) United States Patent
Elliot

(10) Patent No.: US 7,914,000 B2
(45) Date of Patent: Mar. 29, 2011

(54) FEEDBACK-BASED DOCUMENT HANDLING CONTROL SYSTEM

(75) Inventor: Jack Gaynor Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 963 days.

(21) Appl. No.: 11/758,938

(22) Filed: Jun. 6, 2007

(65) Prior Publication Data

US 2008/0306626 A1 Dec. 11, 2008

(51) Int. Cl.
*B65H 7/02* (2006.01)

(52) U.S. Cl. ..... 271/228; 271/227

(58) Field of Classification Search ..... 271/226–255
See application file for complete search history.

(56) References Cited

U.S. PATENT DOCUMENTS

| | | | | |
|---|---|---|---|---|
| 4,417,150 | A | 11/1983 | Moran | |
| 4,506,969 | A | 3/1985 | Baker | |
| 4,511,242 | A | 4/1985 | Ashbee et al. | |
| 4,971,304 | A | 11/1990 | Lofthus | |
| 5,678,159 | A | 10/1997 | Williams et al. | |
| 5,697,609 | A | 12/1997 | Williams et al. | |
| 5,887,996 | A | 3/1999 | Castelli et al. | |
| 2003/0146567 | A1* | 8/2003 | Williams et al. | 271/249 |
| 2005/0263958 | A1 | 12/2005 | Knierim et al. | |
| 2006/0171725 | A1 | 8/2006 | Ruthenberg et al. | |
| 2006/0197038 | A1 | 9/2006 | Park et al. | |
| 2007/0023994 | A1* | 2/2007 | Mandel et al. | 271/226 |
| 2008/0012215 | A1* | 1/2008 | Elliot | 271/228 |
| 2008/0136092 | A1* | 6/2008 | Elliot | 271/228 |
| 2008/0296835 | A1* | 12/2008 | Dejong et al. | 271/227 |

OTHER PUBLICATIONS

Nilanjan Sarkar et al. "Control of Mechanical Systems with Rolling Constraints: Application to Dynamic Control of Mobile Robots", The International Journal of Robotics Research, vol. 13, No. 1, Feb. 1994, pp. 55-69.

Rene Sanchez et al. "Paper Sheet Control Using Steerable Nips", Department of Mechanical Engineering, University of California, Berkeley, California 2004, pp. 482-487.

* cited by examiner

*Primary Examiner* — Stefanos Karmis
*Assistant Examiner* — Prasad V Gokhale
(74) *Attorney, Agent, or Firm* — Pepper Hamilton LLP

(57) ABSTRACT

A method and system for performing sheet registration are disclosed. Output values for a sheet may be identified within a reference frame. A difference between each output value and a corresponding desired output value may be determined. Input values may be determined based on at least the differences. State feedback values may be determined based on information received from one or more sensors. Jerk values may be determined for multiple drive rolls based on the input values and the state feedback values. A desired angular velocity for each drive roll may be determined based on the corresponding jerk value. A motor voltage may be determined for each drive roll that tracks an observed angular velocity value to the desired angular velocity value. The jerk values may create a linear differential relationship between the input values and the output values. The steps may be performed multiple times.

12 Claims, 11 Drawing Sheets

FEEDBACK-BASED DOCUMENT HANDLING CONTROL SYSTEM

CROSS-REFERENCE TO RELATED APPLICATIONS

This application is related to U.S. patent application Ser. No. 11/457,892, fled Jul. 17, 2006, U.S. patent application Ser. No. 11/457,944, filed Jul. 17, 2006. Each of such disclosures is incorporated herein by reference in its entirety.

BACKGROUND

1. Technical Field

The disclosed embodiments generally pertain to sheet registration systems and methods for operating such systems. Specifically, the disclosed embodiments pertain to methods and systems for registering sheets using a closed-loop feedback control scheme.

2. Background

Sheet registration systems are presently employed to align sheets in a device. For example, high-speed printing devices typically include a sheet registration system to align paper sheets as they are transported from the storage tray to the printing area.

Sheet registration systems typically use sensors to detect a location of a sheet at various points during its transport. Sensors are often used to detect a leading edge of the sheet and/or a side of the sheet to determine the orientation of the sheet as it passes over the sensors. Based on the information retrieved from the sensors, the angular velocity of one or more nips can be modified to correct the alignment of the sheet.

A nip is formed by the squeezing together of two rolls, typically an idler roll and drive roll, thereby creating a rotating device used to propel a sheet in a process direction by its passing between the rolls. An active nip is a nip rotated by a motor that can cause the nip to rotate at a variable nip velocity. Typically, a sheet registration system includes at least two active nips having separate motors. As such, by altering the angular velocities at which the two active nips are rotated, the sheet registration system may register (orient) a sheet that is sensed by the sensors to be misaligned.

Numerous sheet registration systems have been developed. For example, the sheet registration system described in U.S. Pat. No. 4,971,304 to Lofthus, which is incorporated herein by reference in its entirety, describes a system incorporating an array of sensors and two active nips. The active sheet registration system provides deskewing and registration of sheets along a process path having an X, Y and Θ coordinate system. Sheet drivers are independently controllable to selectively provide differential and non-differential driving of the sheet in accordance with the position of the sheet as sensed by the array of sensors. The sheet is driven non-differentially until the initial random skew is measured. The sheet is then driven non-differentially to correct the measured skew and to induce a known skew. The sheet is then driven non-differentially until a side edge is detected, whereupon the sheet is driven differentially to compensate for the known skew. Upon final deskewing, the sheet is driven non-differentially outwardly from the deskewing and registration arrangement.

FIGS. 1A and 1B depict an exemplary sheet registration device according to the known art. The sheet registration device 100 includes two nips 105, 110 which are independently driven by corresponding motors 115, 120. The resulting 2-actuator device embodies a simple registration device that enables sheet registration having three degrees of freedom. The under-actuated (i.e., fewer actuators than degrees of freedom) nature makes the registration device 100 a nonholonomic and nonlinear system that cannot be controlled directly with conventional linear techniques. The control for such a system, and indeed for each of the above described systems, employs open-loop (feed-forward) motion planning.

FIG. 2 depicts an exemplary open-loop motion planning control process according to the known art. One or more sensors, such as PE2, CCD1 and CCD2 shown in FIG. 1B, are used to determine an input position of the sheet 125 when the lead edge of the sheet is first detected by PE2 (as represented in FIG. 1B). An open-loop motion planner 205 interprets the information retrieved from the sensors as the input position and calculates a set of desired velocity profiles $\omega_d$ that will steer the sheet along a viable path to the final registered position if perfectly tracked (i.e., assuming that no slippage or other errors occur). One or more motor controllers 210 are used to control the velocities ω. The one or more motor controllers 210 generate motor voltages $u_m$ for the motors 115, 120. The motor voltages $u_m$ determine the angular velocities ω at which each corresponding nip 105, 110 is rotated. For example, a DC brushless servo motor can be used to create a pulse width modulated voltage $u_{m1}$ to track a desired velocity $\omega_1$. Alternately, any of a stepper motor, an AC servo motor, a DC brush servo motor, and other motors known to those of ordinary skill in the art can be used. The sheet velocity at each nip 105, 110 is computed as the radius (c) of the drive roll multiplied by the angular velocity of the roll ($\omega_1$ for 105 and $\omega_2$ for 110). By matching the angular velocities of the nips 105, 110 to $\omega_d$, sheet registration can be achieved. Alternately, the motor controller 210 can include a feed-forward torque-based motor controller.

Although the sheet is not monitored for path conformance during the process, an additional set of sensors, such as PEL, CCDL, and CCD1 in FIG. 1B, can be placed at the end of the registration system 100 to provide a snapshot of the output for adapting the motion planning algorithm. However, because path conformance is not monitored, error conditions that occur in an open-loop system may result in errors at the output that require multiple sheets to correct. In addition, although open-loop motion planning can be used to remove static (or "DC") sources of error, the open-loop nature of the underlying motion planning remains vulnerable to changing (or "AC") sources of error Accordingly, the sheet registration system may improperly register the sheet due to slippage or other errors in the system.

Systems and methods for improving the registration of misaligned sheets in a sheet registration system, for using a closed-loop feedback control system in a sheet registration system for linearizing the inputs of a sheet registration system to the outputs to enable closed-loop feedback, and/or for scheduling gain in a sheet registration system to control the resulting nip forces and sheet tail wag within design constraints while converging the sheet to a desired trajectory within a pre-determined time would be desirable.

The present embodiments are directed to solving one or more of the above-listed problems.

SUMMARY

As used herein and in the appended claims, the singular forms "a," "an," and "the" include plural reference unless the context clearly dictates otherwise. As used herein, the term "comprising" means "including, but not limited to."

In an embodiment, a method of performing sheet registration may include identifying output values for a sheet within a reference frame, determining a difference between each output value and a corresponding desired output value, determining input values for the sheet based on at least the differences, determining state feedback values based on information received from one or more sensors, and, for each of a plurality of drive rolls, determining a jerk value based on the input values and the state feedback values, determining a desired angular velocity value based on the jerk value, and determining a motor voltage for a motor for the drive roll that tracks an observed angular velocity value for the drive roll to the desired angular velocity value for the drive roll. The jerk values may create a linear differential relationship between the input values and the output values. The above-listed steps are performed a plurality of times.

In an embodiment, a system for performing sheet registration may include one or more sensors, a plurality of drive rolls, a plurality of motors and a processor. Each motor may be associated with at least one drive roll. The processor may include a state feedback determination module configured to determine state feedback values based on information received from the one or more sensors, an output value identification module configured to determine output values based on the state feedback values, a difference generation module configured to determine the difference between each output value and a desired value for each output value, an input value determination module configured to determine input values based on at least the differences, a jerk value determination module configured to determine a jerk value for each drive roll based on the input values and the state feedback values, an angular velocity determination module configured to determine a desired angular velocity value for each drive roll based on the jerk value for the drive roll, and a motor voltage determination module configured to determine a motor voltage for each motor. The motor voltage determination module may be configured to track an observed angular velocity value for each drive roll to the desired angular velocity value for the drive roll. The jerk values may create a linear differential relationship between the input values and the output values.

In an embodiment, a method of aligning a sheet in a printing device may include receiving a sheet by a device having a plurality of drive rolls, wherein each drive roll has an acceleration, identifying a desired trajectory for the sheet, determining a current position of the sheet, adjusting the acceleration of at least one drive roll based on the current position and the desired trajectory, and repeating the determining and adjusting a plurality of times so that the sheet moves along the desired trajectory.

In an embodiment, a system for aligning a sheet may include a transport module configured to receive a sheet, a trajectory module configured to determine a desired trajectory for the sheet, a sensor module configured to determine a current position of the sheet, and one or more motors. The transport module may include a plurality of drive rolls. Each drive roll may have an acceleration. Each motor may be configured to adjust the acceleration of at least one drive roll based on the current position and the desired trajectory. The one or more sensors may be configured to determine the position of the sheet a plurality of times and the one or more motors may be configured to adjust the acceleration of at least one drive roll a plurality of times so that the sheet moves along the desired trajectory.

BRIEF DESCRIPTION OF THE DRAWINGS

Aspects, features, benefits and advantages of the present invention will be apparent with regard to the following description and accompanying drawings, of which.

DETAILED DESCRIPTION

A closed-loop feedback control process may have numerous advantages over open-loop control processes, such as the one described above. For example, the closed-loop control process may improve accuracy and robustness. The inboard and outboard nips 105, 110 may be the two actuators for a sheet registration system. However, error between desired and actual sheet velocities may occur. Error may be caused by, for example, a discrepancy between the actual sheet velocity and an assumed sheet velocity. Current systems assume that the rotational motion of parts within the device, specifically the drive rolls that contact and impart motion on a sheet being registered, exactly determine the sheet motion. Manufacturing tolerances, nip strain and slip may create errors in the assumed linear relationship between roller rotation and sheet velocity. Also, finite servo bandwidth may lead to other errors. Even if the sheet velocity is perfectly and precisely measured tracking error may exist as the desired velocity chances for a sheet. Error may also result in the presence of noise and disturbances.

The proposed closed-loop algorithm may take advantage of position feedback during every sample period to increase the accuracy and robustness of registration. Open-loop motion planning cannot take advantage of position feedback. As such, the open-loop approach may be subject to inescapable sheet velocity errors that lead directly to registration error. In contrast, the closed-loop approach described herein may use feedback to ensure that the sheet velocities automatically adjust in real-time based on the actual sheet position measured during registration. As such, the closed-loop approach may be less sensitive to velocity error and servo bandwidth and may be more robust as a result.

In addition, current open-loop algorithms may rely on learning based on performance assessment to satisfy performance specifications. Additional sensors may be required to perform the learning process increasing the cost of the registration system. When a novel sheet is introduced, such as, for example, during initialization of a printing machine, when feed trays are changed, and/or when switching between two sheet types, "out of specification" performance may occur for a plurality of sheets while the algorithm converges. In some systems, the out of specification performance may exist for 20 sheets or more.

Figure 1A:
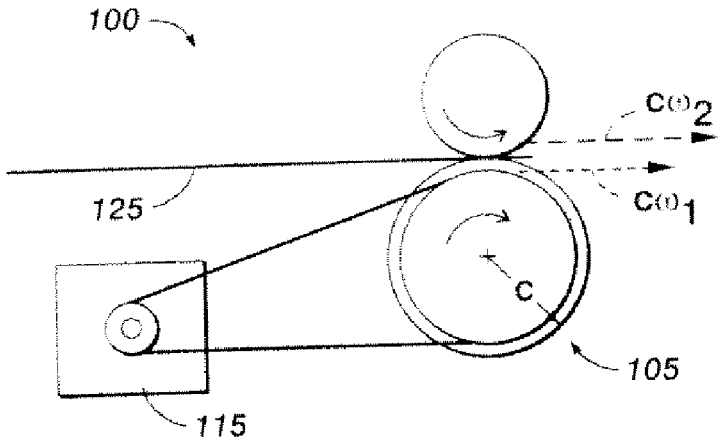
FIGS. 1A and 1B depict an exemplary sheet registration device according to the known art.
Figure 1B:
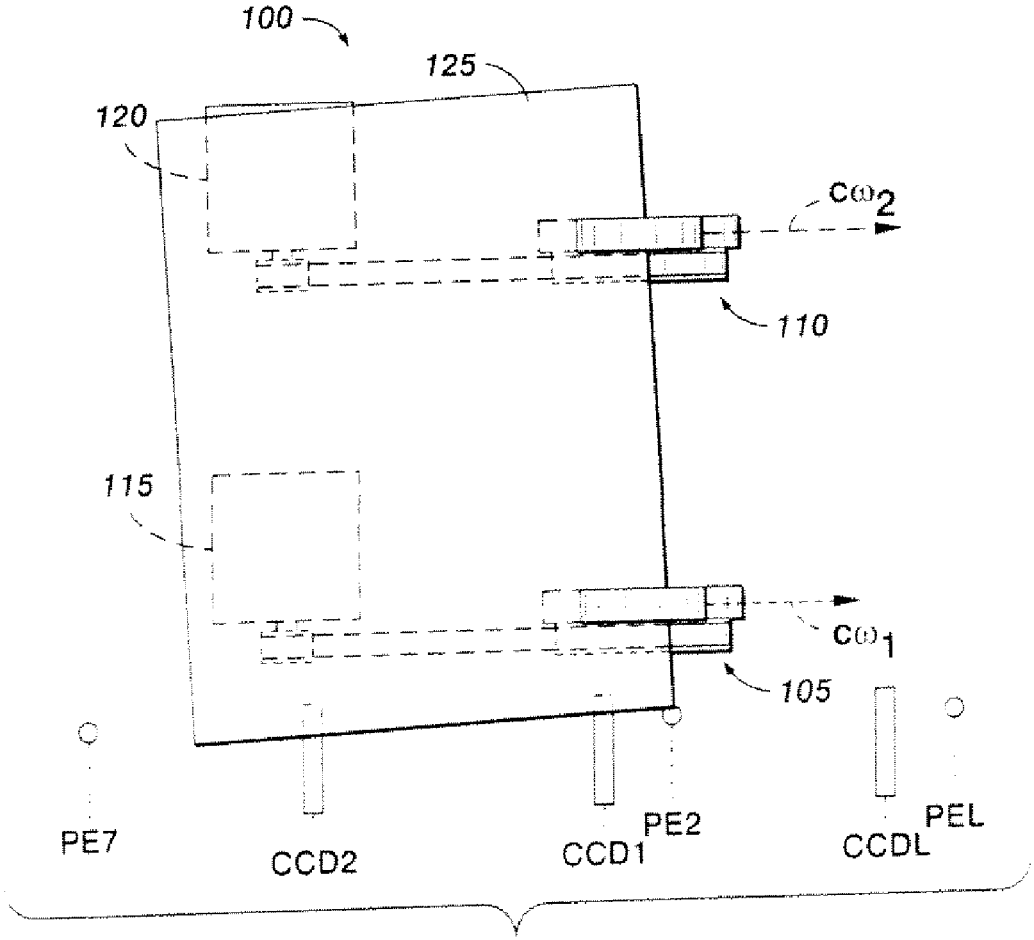
Figure 2:
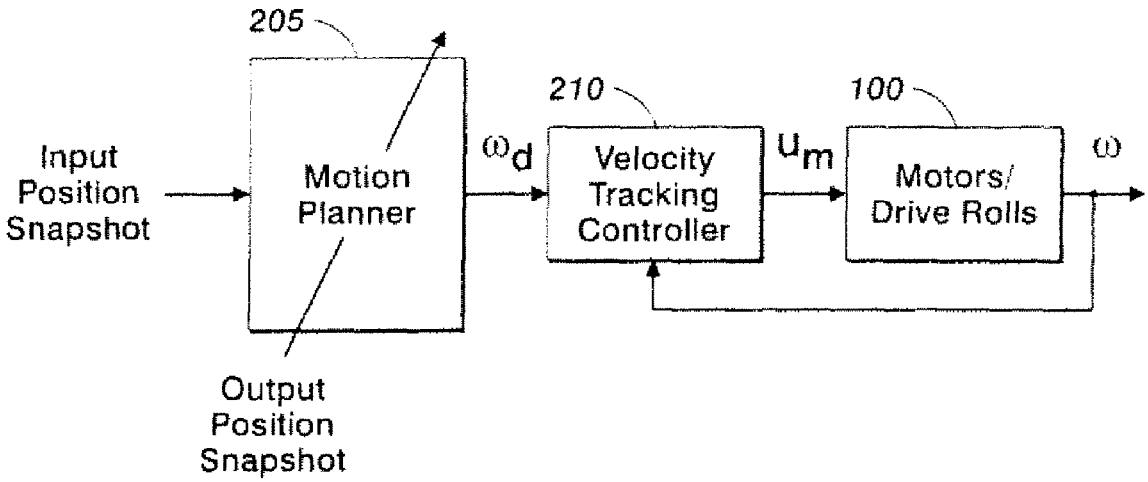
FIG. 2 depicts an exemplary open-loop motion planning control process according to the known art.
Figure 3:
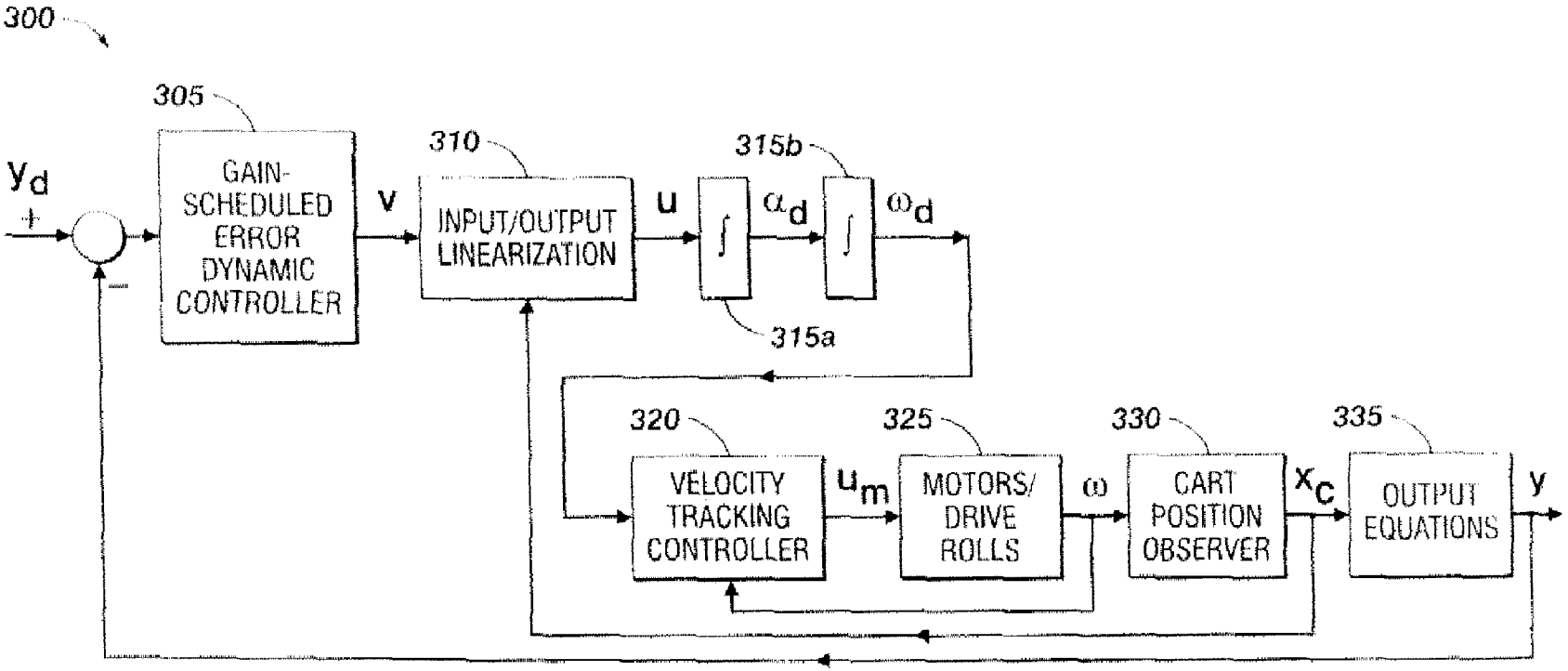
FIG. 3 depicts an exemplary closed-loop feedback control process according to an embodiment.

FIG. 3 depicts an exemplary closed-loop feedback control process according to an embodiment. The closed-loop control process 300 may use information retrieved from a sheet registration system, such as the system shown in FIGS. 1A and 1B, to register a sheet. Information retrieved from the sensors, such as CCD1, CCD2, CCDL, PE2, PEL and encoders on the roll shafts, may be used to determine a position and rotation of a sheet during the registration process. Other sheet registration systems, having more or fewer sensors that are placed in a variety of locations, may be used within the scope of the present disclosure, which is not limited to use with the system shown in FIGS. 1A and 1B.

Figure 4A:
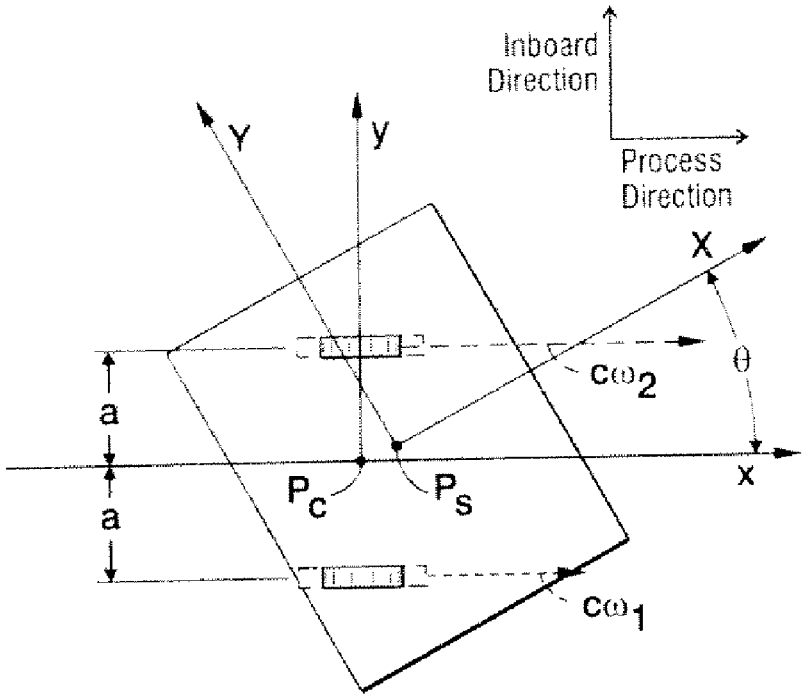
FIG. 4A depicts an exemplary reference frame based on the drive rolls.
Figure 4B:
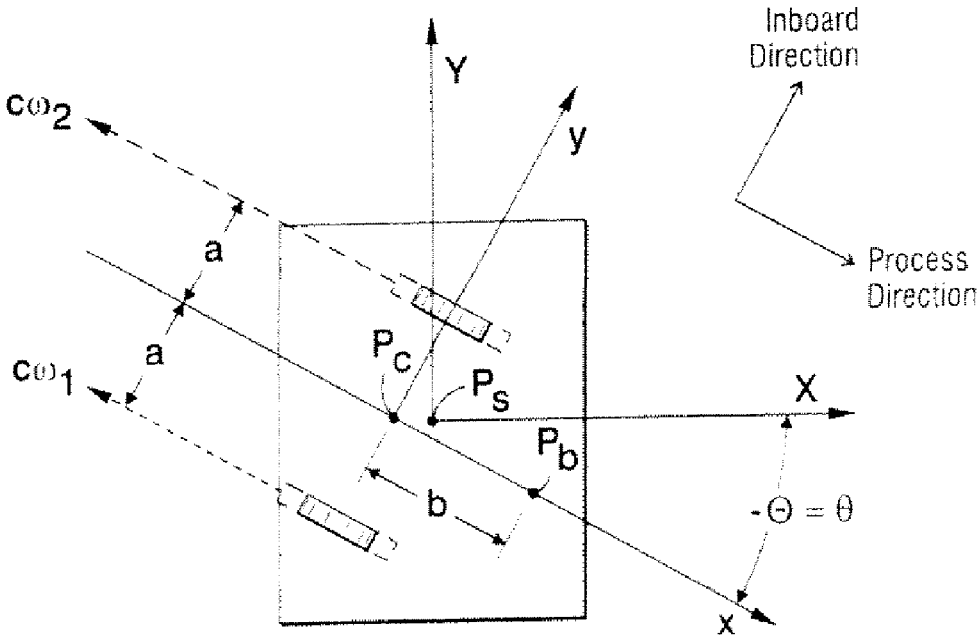
FIG. 4B depicts an exemplary reference framed based on the orientation of the sheet in the process according to an embodiment.

Referring back to FIG. 3, a reference frame may initially be selected (for example, as described below in reference to FIGS. 4A and 4B), and two outputs y may be selected based on the reference frame. A coordinate system is constructed within a reference frame (i.e., a perspective from which a system is observed) to analyze the operation of the sheet registration system. For example, the reference frame in FIG. 4A is selected based upon the orientation of the drive rolls (nips). In contrast, the reference frame in FIG. 4B is selected based upon the orientation of the sheet.

To be effective, the input-output linearization module 310 may require the selection of an appropriate reference frame. FIG. 4A depicts an exemplary reference frame based on the drive rolls, where the process direction (i.e., the direction that the sheet is intended to be directed) is defined to be the x-axis, and the y-axis is perpendicular to the x-axis in, for example, an inboard direction. A five dimensional state vector x may be defined in the basis of this reference frame:

$$x=[xy\theta\omega_1\omega_2]^T,$$

where:

$\{x, y\}$ denote the coordinates of the center of mass of the sheet ($P_s$);

$\theta$ denotes the angle of the sheet relative to the x-axis; and $\{\omega_1, \omega_2\}$ denote the angular velocities of the outboard and inboard drive rolls, respectively.

The sheet states $q=[x\ y\ \theta]$ are a subset of state vector x. If no slip exists between the drive rolls and the sheet, three kinematic equations may relate the sheet states to the angular velocities:

$$\dot{\theta} = \frac{c(\omega_1 - \omega_2)}{2a},$$

$$\dot{x} = \frac{c(\omega_1 + \omega_2)}{2} - y\dot{\theta},$$

and $$\dot{y} = x\dot{\theta},$$

where:

c denotes the radius of the drive rolls; and 2a denotes the distance between the rolls as shown in FIG. 4A.

The fundamental goal of a sheet registration device may be to make a point on the sheet track a desired straight line path with zero skew at the process velocity. In the basis of the reference frame, this desired trajectory is described by:

$$x_d(t)=v_d t+x_{di},\ y_d(t)=y_{di},\ \text{and}\ \theta_d(t)=0,$$

where:

$v_d$ denotes the process velocity; and $\{x_{di}, y_{di}\}$ describes the desired initial position of the center of mass of the sheet.

One problem with the reference frame shown in FIG. 4A is that input-output linearization cannot be applied because no two outputs y can be readily found in the basis of the frame that guarantee the convergence of the three sheet states q to the desired sheet trajectory. Accordingly, a different reference frame must be determined that can satisfy this requirement in order to provide closed-loop feedback linearization.

FIG. 4B depicts an exemplary reference frame based on the orientation of the sheet in the process according to an embodiment. The reference frame in FIG. 4B may incorporate a virtual body fixed to the drive rolls. The drive rolls and the virtual body may form a "cart" riding along the underside of the sheet to describe an XY reference frame. A five dimensional state vector may be defined with respect to the XY reference frame:

$$x_c=[XY\Theta\omega_1\omega_2\alpha_1\alpha_2]^T,$$

where:

$\{X, Y\}$ denote the coordinates of the center of the cart ($P_c$);

$\Theta$ denotes the angle between the cart and the XY coordinate system;

$\{\omega_1, \omega_2\}$ denote the angular velocities of the outboard and inboard drive rolls, respectively; and $\{\alpha_1, \alpha_2\}$ denote the angular accelerations of the outboard and inboard drive rolls, respectively. These angular velocities and angular accelerations are common to state vector x within the xy frame.

The cart states may be defined as a subset of $x_c$, $q_c=[X\ Y\ \Theta]^T$. The transformations between the sheet and the cart states may be defined as:

$$X=-(x\cos\theta+y\sin\theta),\ Y=-(-x\sin\theta+y\cos\theta),\ \Theta=-\theta.$$

The cart and sheet orientations, $\Theta$ and $\theta$, may differ in sense because the cart "moves" in the opposite direction of the sheet. In other words, if the sheet were a surface on which the drive wheels propelled the virtual cart, the drive wheels would propel the cart in a direction substantially opposite from the process direction. By substituting these transformations into the desired sheet trajectory determined above, the desired cart trajectory that achieves sheet registration may be determined: $X_d(t)=-v_d t-x_{di}$, $Y_d(t)=-y_{di}$, and $\Theta_d(t)=0$.

The outputs y may correspond to the position of a center of the virtual cart, which may be determined by using information retrieved from the one or more sensors. A set of desired outputs $y_d$ may also be determined. In an embodiment, the desired output values may correspond to the position of a point that is on a line bisecting the nips (wheels of the cart) 105, 110. In operation, the convergence of the outputs y to the desired outputs $y_d$ may guarantee convergence of the three sheet states (i.e., the two-dimensional position of the sheet and the rotation of the sheet with respect to a process direction) to the desired (registered) trajectory. The differences between the values of the desired outputs and the corresponding current output values may be used as input values to a gain-scheduled error dynamics controller 305 that accounts for error dynamics. This controller 305 may have output values v.

Due to the limited amount of time available to perform registration, employing gain-scheduling or a variable set of gains within the error dynamics controller 305 may be a vital component in a sheet registration system employing closed-loop Feedback control. Gain scheduling may be used, for example, by sheet registration systems in the presence of otherwise insurmountable constraints with, for example, a static set of gains. A gain schedule effectively minimizes the forces placed on a sheet while still achieving sheet registration. The gain-scheduled error dynamics controller 305 may perform this by, for example, starting with low gains to minimize the high accelerations characteristic of the early portion of registration and then increasing the gain values as the sheet progresses through the sheet registration system to guarantee convergence in the available time.

An input-output linearization module 310 may receive the outputs of the error dynamics controller 305 (v) and state feedback values $x_c$ to produce jerk values u for the nips 105, 110. The state feedback values $x_c$ may include, for example, the position and rotation of the sheet and the angular velocities of each drive roll associated with a nip 105, 110. The sheet position and rotation may be determined based on sensor information from, for example the sensors described above with respect to FIG. 1B or any other sensor configuration that can detect the orientation of a sheet. The angular velocity of each drive roll may be determined by, for example, encoders and/or sensors on the drive roll. The jerk values u may be used to create a linear differential relationship between the inputs v and the outputs y of the closed-loop feedback control process.

Kinematic equations (based on an assumption of no slip) for the cart may include:

$$\dot{X}\cos\Theta+\dot{Y}\sin\Theta+a\dot{\Theta}+c\omega_1=0,\ \dot{X}\cos\Theta+\dot{Y}\sin\Theta-a\dot{\Theta}+a\dot{\Theta}+c\omega_2=0 \text{ and } \dot{Y}\cos\Theta-\dot{X}\sin\Theta=0,$$

which can be rearranged and written in matrix form as:

$$\dot{q}_c - S(q_c)\omega(t)$$

$$\text{where: } S(q_c) = -\begin{bmatrix} \frac{1}{2}c\cos\Theta & \frac{1}{2}c\sin\Theta & \frac{c}{2a} \\ \frac{1}{2}c\cos\Theta & \frac{1}{2}c\sin\Theta & -\frac{c}{2a} \end{bmatrix}^T; \text{ and}$$

$$\omega(t) = [\,\omega_1 \quad \omega_2\,]^T.$$

Assuming a set of jerks $u=[u_1\ u_2]^T$, the resulting cart state equations may be written in standard matrix form:

$$\dot{x}_c = f(x_c) + G(x_c)u,$$

$$\text{where: } f(x_c) = \begin{bmatrix} \underset{1\times3}{(S\omega)^T} & \underset{1\times4}{0} \end{bmatrix}^T,\ G(x_c) = \begin{bmatrix} \underset{2\times5}{0} & \underset{2\times2}{I} \end{bmatrix}^T.$$

As with the angular velocities of the drive rolls ω, the jerks of the drive rolls u may be common to the equations of both reference frames.

The position of a point $P_b$ (an exemplary $P_b$ is shown in FIG. 4B) may be selected to define the outputs y. $P_b$ may be used to assist in achieving linearization between the inputs and the outputs to the sheet registration system. The position of $P_b$ may be described in equation form as: $y=h(q_c)=[X_b\ Y_b]^T=[X+b\cos\Theta\ Y+b\sin\Theta]^T$. Substituting the desired trajectory of the cart into these equations may result in the corresponding desired output equations: $y_d=[y_{d_1}\ y_{d_2}]^T=[-v_dt=x_{di}+b-y_{di}]^T$. Convergence of outputs y to desired values $y_d$ may guarantee convergence of cart states $q_c$ to the desired cart trajectory, which in turn may guarantee the convergence of the sheet states q to the desired (registered) sheet trajectory.

In order to perform linearization between the inputs and the outputs, the output must be recursively differentiated until a direct relationship exists between the inputs and the outputs. Differentiating the outputs once provides the following:

$$\begin{aligned} \dot{y} &= \frac{d}{dt}h(x_c) \\ &= \nabla h(x_c)\dot{x}_c \\ &= \nabla h(x_c)(f+Gu) \\ &= L_f h + L_g hu \end{aligned}$$

where:

$$L_f h = \begin{bmatrix} L_f h_1 \\ L_f h_2 \end{bmatrix} \text{ and } L_g h = \begin{bmatrix} L_{g_1} h_1 & L_{g_2} h_1 \\ L_{g_1} h_2 & L_{g_2} h_2 \end{bmatrix}.$$

Here, $\nabla h(x_c)$ denotes the Jacobian of $h(x_c)$ and subscripts f, $g_1$ and $g_2$ indicate f, the first column of G and the second column of G, respectively. The Lie derivative of any scalar h with respect to any vector f is a scalar function defined by $L_f h=\nabla hf$ (essentially the directional derivative of h in an f space: $f\cdot\Delta h$). Evaluating the second term of the right hand side of the equation above results in $$L_g h = \begin{bmatrix} 0 & 0 \\ 0 & 0 \end{bmatrix},$$

which establishes that the first differentiation does not introduce the output.

Differentiating a second time may provide the following equation:

$$\ddot{y} = \frac{d}{dt}\dot{y} = \nabla(L_f h)\dot{x}_c = L_f^2 h + L_g L_f hu,$$

$$\text{where: } L_f^2 h = \begin{bmatrix} L_f^2 h_1 \\ L_f^2 h_2 \end{bmatrix} \text{ and } L_g L_f h = \begin{bmatrix} L_{g_1} L_f h_1 & L_{g_2} L_f h_1 \\ L_{g_1} L_f h_2 & L_{g_2} L_f h_2 \end{bmatrix} = \begin{bmatrix} 0 & 0 \\ 0 & 0 \end{bmatrix},$$

which establishes that a second differentiation does not produce the output.

Differentiating a third time may provide the following equation:

$$\dddot{y} = \frac{d}{dt}\ddot{y} = \nabla(L_f^2 h)\dot{x}_c = L_f^3 h + L_g L_f^2 hu = H + \Psi u$$

$$\text{where: } H = L_f^3 h = \begin{bmatrix} L_f^3 h_1 \\ L_f^3 h_2 \end{bmatrix} \text{ and } \Psi = L_g L_f^2 h = \begin{bmatrix} L_{g_1} L_f^2 h_1 & L_{g_2} L_f^2 h_1 \\ L_{g_1} L_f^2 h_2 & L_{g_2} L_f^2 h_2 \end{bmatrix}.$$

In this case, $$\Psi = -\frac{c}{2a}\begin{bmatrix} a\cos\Theta - b\sin\Theta & a\cos\Theta + b\sin\Theta \\ b\cos\Theta + a\sin\Theta & -b\cos\Theta + a\sin\Theta \end{bmatrix}.$$

Both rows of ψ may be non-zero (i.e., each row contains at least one non-zero element). Accordingly, the value of at least one input may appear in both outputs after three differentiations. The determinant of $\psi$ may be seen to be nonzero if b is nonzero: i.e., the decoupling matrix is non-singular. The inverse of $\psi$ may be computed to be:

$$\Psi^{-1} = -\frac{1}{bc}\begin{bmatrix} -a\sin\Theta + b\cos\Theta & a\cos\Theta + b\sin\Theta \\ a\sin\Theta + b\cos\Theta & -a\cos\Theta + b\sin\Theta \end{bmatrix}.$$

An input $v=[v_1\ v_2]^T$ may be introduced, and u may be defined in terms of v as $u=\psi^{-1}(v-H)$. u may be solved in closed form as:

$$\begin{bmatrix} u_1 \\ u_2 \end{bmatrix} = \frac{1}{4a^2bc}\begin{bmatrix} 4a^2(-b\cos\Theta + a\sin\Theta)v_1 - 4a^2(a\cos\Theta + b\sin\Theta)v_2 + \\ c^2(bc\omega_1(\omega_1-\omega_2)^2 + \alpha_1(3(a^2-b^2)\omega_1 - (a^2+3b^2)\omega_2) + \\ \alpha_2((a^2+3b^2)\omega_1 - 3(a^2-b^2)\omega_2)) \\ -4a^2(b\cos\Theta + a\sin\Theta)v_1 + 4a^2(a\cos\Theta - b\sin\Theta)v_2 + \\ c^2(bc\omega_2(\omega_1-\omega_2)^2 + \alpha_1(-3(a^2+b^2)\omega_1 - (a^2+3b^2)\omega_2) + \\ \alpha_2(-(a^2-3b^2)\omega_1 - 3(a^2-b^2)\omega_2)) \end{bmatrix}.$$

Substituting u into the equation for $\dddot{y}$, the problem is reduced to the third order vector equation: $\dddot{y}=v$. This system is linear and uncoupled because each input $v_i$ only affects a corresponding output $y_i$.

Having reduced the problem to a linear form, the error $e=[e_1\ e_2]^T$ may be $e=y_d-y$. The error dynamics may now be constructed by expressing v as a function of e and $y_d$:

$$\begin{bmatrix} v_1 \\ v_2 \end{bmatrix} = \begin{bmatrix} \dddot{y}_{d_1} + k_{dd1}\ddot{e}_1 + k_{d_1}\dot{e}_1 + k_{p_1}e_1 \\ \dddot{y}_{d_2} + k_{dd_2}\ddot{e}_2 + k_{d_2}\dot{e}_2 + k_{p_2}e_2 \end{bmatrix},$$

which may be written as:

$$\begin{bmatrix} \dddot{e}_1 + k_{dd_1}\ddot{e}_1 + k_{d_1}\dot{e}_1 + k_{p_1}e_1 \\ \dddot{e}_2 + k_{dd_2}\ddot{e}_2 + k_{d_2}\dot{e}_2 + k_{p_2}e_2 \end{bmatrix} = \begin{bmatrix} 0 \\ 0 \end{bmatrix}.$$

Because these equations are uncoupled, the values of $k_{dd_1}$, $k_{d_1}$ and $k_{p_1}$ (second-derivative, derivative and proportional gain values for each drive roll) directly place the poles.

As the output error e converges to zero, the cart state error also converges to zero, but with a phase lag. The amount of phase lag between the convergence of the output and cart state may be adjustable via b. Using a smaller b may result in a smaller lag. In all, seven parameters may be used to adjust the rate of convergence the six gain values ($k_{dd}=[k_{dd_1}\ k_{dd_2}]^T$, $k_d=[k_{d_1}\ k_{d_2}]^T$, and $k_p=[k_{p_1}\ k_{p_2}]^T$) and the value of b.

If no system constraints existed, the gain parameters mentioned above ($k_{dd}$, $k_d$, $k_p$ and b) would suffice to determine the control of the sheet. However, the time period for sheet registration is limited based on the throughput of the device. In addition, violating maximum tail wag and/or nip force requirements may create image quality defects. Tail wag and nip force refer to effects which may damage or degrade registration of the sheet. For example, excessive tail wag could cause a sheet to strike the side of the paper path. Likewise, if a tangential nip force used to accelerate the sheet exceeds the force of static friction, slipping between the sheet and drive roll will occur.

To satisfy the time constraints for a sheet registration system high gain ($k_{dd}$, $k_d$, $k_p$) values and a small value of b may be desirable. However, to limit the effects of tail wag and nip force below acceptable thresholds, small gain values and a large value of b may be required. Depending on the input error and machine specifications, a viable solution may not exist if the gain values are static.

In order to circumvent these constraints, gain scheduling may be employed to permit adjustment of the gain values during the sheet registration process. Relatively low gain values may be employed at the onset of the registration process in order to satisfy max nip force and tail wag constraints, and relatively higher gain values may be employed towards the end of the process to guarantee timely convergence. The gain values may be adjusted to maintain a consistent amount of damping. In an alternate embodiment, the damping may also be modified. Although the value of b is not technically a gain value, the value of b may also be scheduled to provide an additional degree of freedom.

Referring back to FIG. 3, for input-output linearization to be effective, jerks u may be accurately tracked at the drive rolls 325. To achieve this, the jerks u may be integrated twice 315*a* and 315*b* to produce the desired velocities $\omega_d$. One or more motor controllers 320 may be used to control the velocities $\omega=[\omega_1\ \omega_2]^T$. The one or more motor controllers 320 may generate motor voltages $u_m$ for the motors that drive the drive rolls 325. The motor voltages $u_m$ may determine the angular velocities $\omega$ at which each corresponding drive roll 325 is rotated. For example, a DC brushless servo motor may be used to create a pulse width modulated voltage $u_{m1}$ to track a desired velocity $\omega_1$. In an alternate embodiment, any of a stepper motor, an AC servo motor, a DC brush servo motor, and other motors known to those of ordinary skill in the art can be used. The sheet velocity at each nip 105, 110 is computed as the radius (c) of the nip multiplied by the angular velocity of the nip ($\omega_1$ for 105 and $\omega_2$ for 110). The sheet velocity at each drive roll 325 may be defined as the radius (c) of the nip multiplied by the angular velocity of the drive roll. As shown in FIG. 3, each motor controller 320 may comprise a velocity controller.

The sheet velocity at each drive roll 325 may be defined as the radius (c) of the by the angular velocity of the drive roll. As shown in FIG. 3, each motor controller 320 may comprise a velocity controller. In an alternate embodiment, a torque controller (not shown) may be used to control the torque exerted by the corresponding motor.

The input-output linearization module 310 may utilize position feedback $x_c$ that is generated every sample period. An observer module 330 may employ the following kinematic equations for the cart to evolve the cart position $x_c$ based on the measured drive roll velocities $\omega$:

$$\dot{X} = \frac{-c(\omega_1+\omega_2)}{2}\cos\Theta,$$

$$Y = \frac{-c(\omega_1+\omega_2)}{2}\sin\Theta,$$

$$\dot{\Theta} = \frac{-c(\omega_1-\omega_2)}{2a}.$$

The observer module 330 may be utilized by an input position snapshot provided by the sensors. Only the cart position may be needed because the reference frame for the linearization module 310 may be based on the cart state $x_c$. The cart state values $x_c$ may be converted to the corresponding sheet state values $q_c$ using, for example, a processor 335 to compute the equations defined above.

Figure 5:
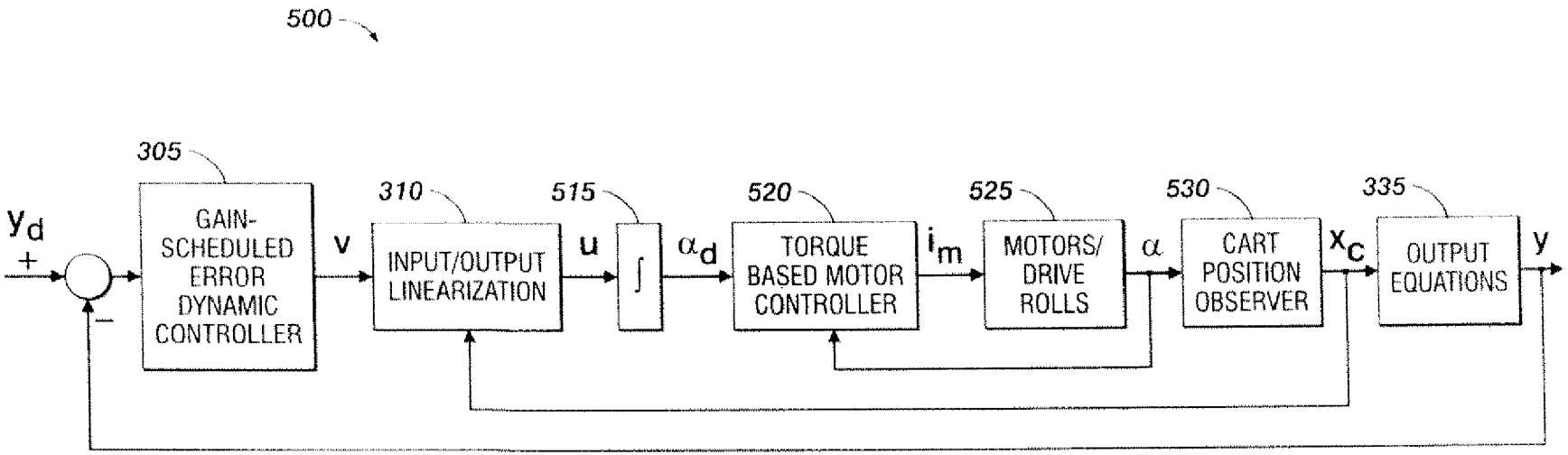
FIG. 5 depicts an alternate exemplary closed-loop feedback control process according to an embodiment.

FIG. 5 depicts an alternate exemplary closed-loop feedback motion planning control process according to an embodiment. As shown in FIG. 5, the closed-loop control process 500 may include a gain-scheduled error dynamics controller 305, input-output linearization module 310 and processor 335 performing substantially the same operations as the corresponding devices described above in reference to FIG. 3. The jerks u from the input-output linearization module 310 may be integrated 515 to determine desired acceleration values $\alpha_d$. One or more motor controllers 520 may be used to control the accelerations $\alpha=[\alpha_1\ \alpha_2]^T$. The one or more motor controllers 520 may adjust the torque by supplying a winding current in $i_m=[i_{m1}\ i_{m2}]^T$ to the motors that drive the drive rolls 525 in order to track $\alpha$ to $\alpha_d$. The winding current $i_m$ may determine the angular accelerations a at which each corresponding drive roll 525 is rotated.

The input-output linearization module 310 may utilize position feedback $x_c$ that is generated every sample period. An observer module 530 may employ kinematic equations for the cart to evolve the cart position $x_c$ based on the measured drive roll accelerations $\alpha$. The observer module 530 may be initialized by an input position snapshot provided by the sensors. Only the cart position may be needed because the reference frame for the linearization module 310 may be based on the cart state $x_c$. The cart state values $x_c$ may be converted to the corresponding sheet state values $q_c$ using, for example a processor 335 to compute the equations defined above.

EXAMPLE

A computer simulation was performed of an exemplary sheet registration system designed according to an embodiment. The registration of an 8.5×11 in. sheet of paper was performed at a process velocity of approximately 1.025 m/s, which correlates to approximately 200 pages per minute. The process velocity reduces to a registration time of approximately 0.1425 seconds, which is the time in which input-output linearization must converge in order to function properly in the system.

It was assumed that the sheet feeding mechanism produced 5.0 mm of input lateral error, −0.5 mm of input process error, and 5.0 mrad of input skew error. Fixed gain values $k_{dd}=[330, 330]^T$, $k_d=[36625\ 36625]^T$, and $k_p=[1371000\ 1371000]^T$ were used, which may be replaced with gain scheduled values as described above. The value for b was maintained at −10 mm.

Figure 6:
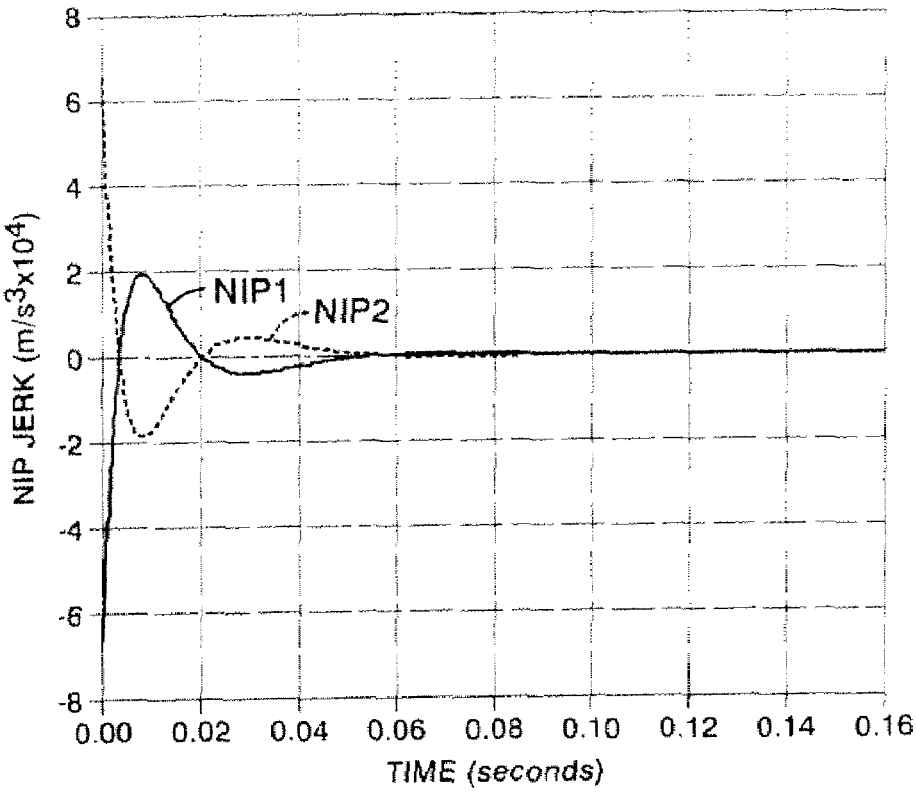
FIG. 6 depicts a graph of the nip jerks for each nip in an exemplary embodiment.
Figure 7:
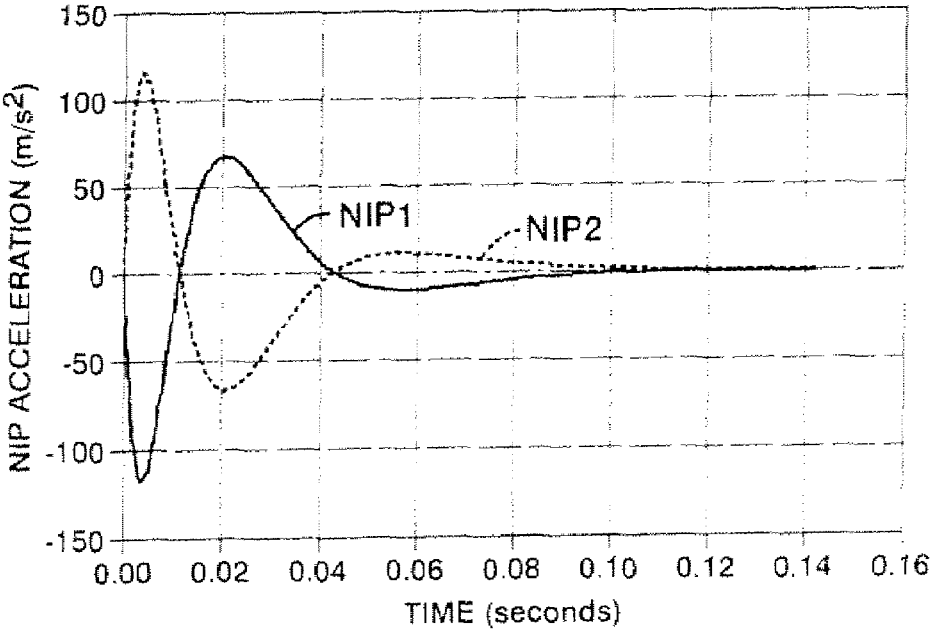
FIG. 7 depicts a graph of the nip accelerations for each nip in an exemplary embodiment.
Figure 8:
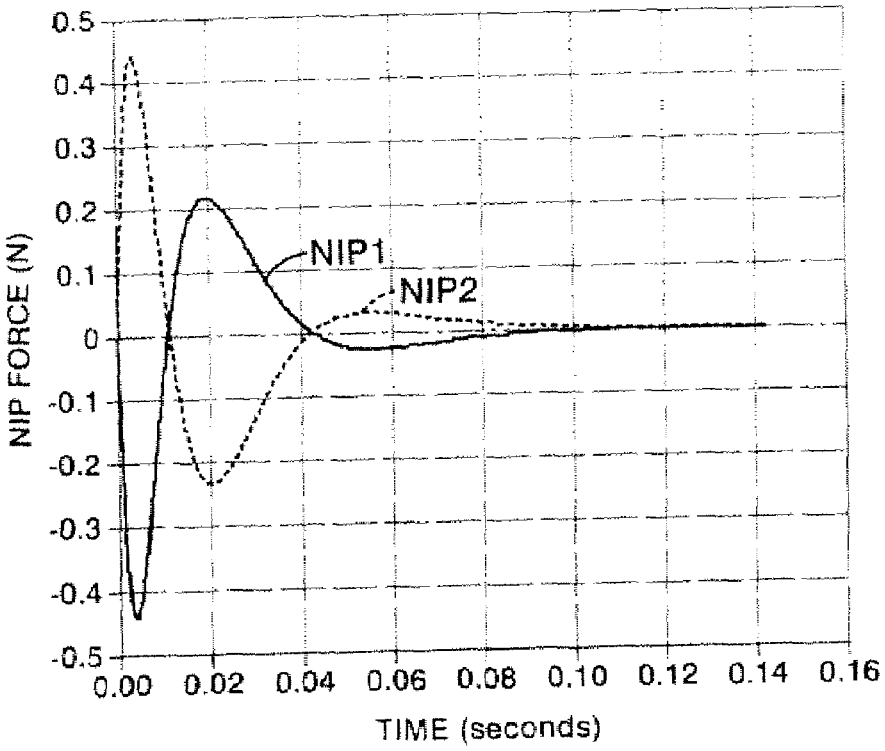
FIG. 8 depicts a graph of the nip forces for each nip in an exemplary embodiment.

FIG. 6 depicts a graph of the nip jerks for each nip. The nip jerks may represent the control inputs for the sheet registration system. FIG. 7 depicts a graph of the nip accelerations for each nip. Each nip acceleration may be computed by integrating the corresponding nip jerk. FIG. 8 depicts a graph of the nip forces for each nip assuming a 20 lb. (75 grams per square meter) sheet of paper is being registered.

Figure 9:
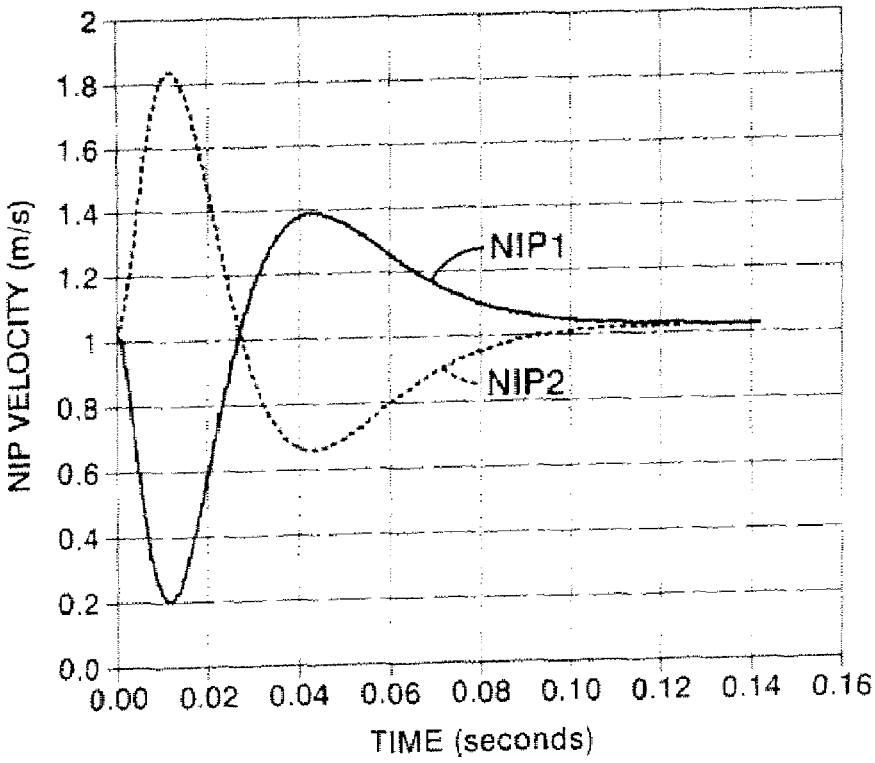
FIG. 9 depicts a graph of the nip velocities for each nip in an exemplary embodiment.

FIG. 9 depicts a graph of the nip velocities for each nip. For the simulation, the desired angular velocities for each drive roll and the actual angular velocities for each drive roll produced by the sheet registration system were assumed to be identical.

Figure 10:
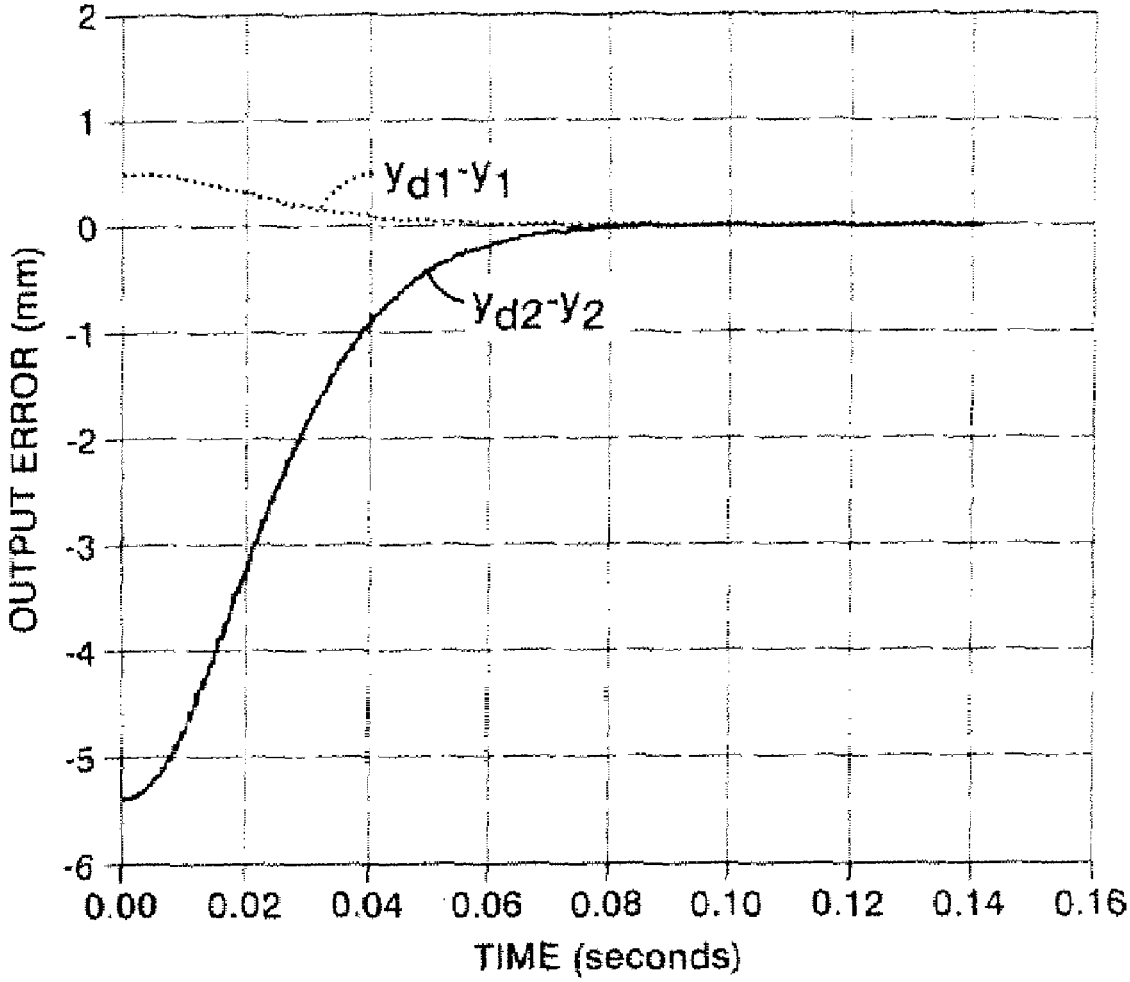
FIG. 10 depicts a graph of the output error for the virtual cart in an exemplary embodiment.
Figure 11A:
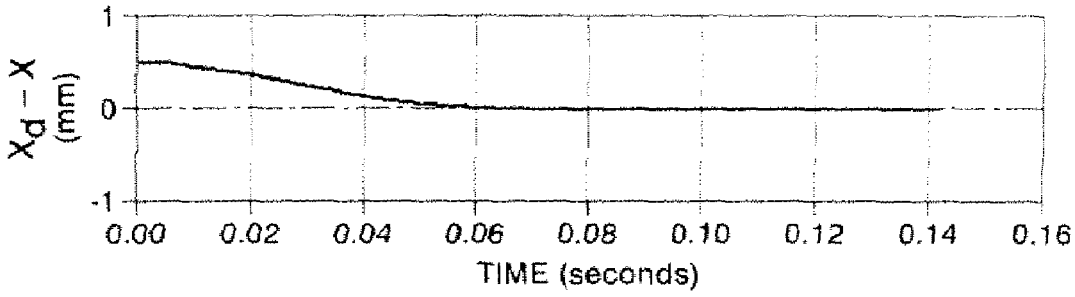
FIGS. 11A-C depict graphs of the error for the X, Y and Θ states for the cart in an exemplary embodiment, respectively.
Figure 11B:
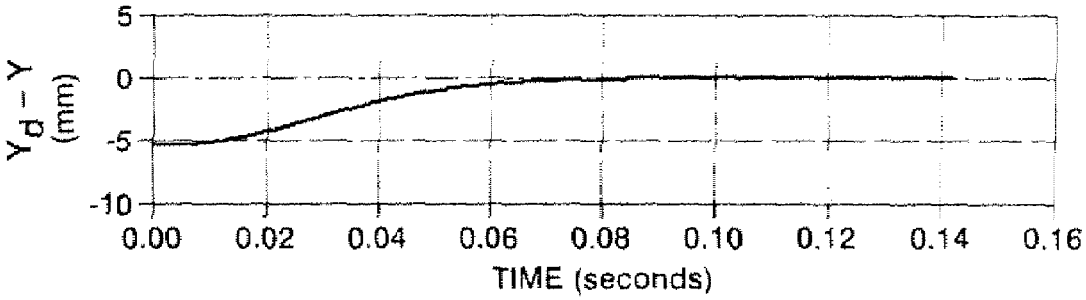
Figure 11C:
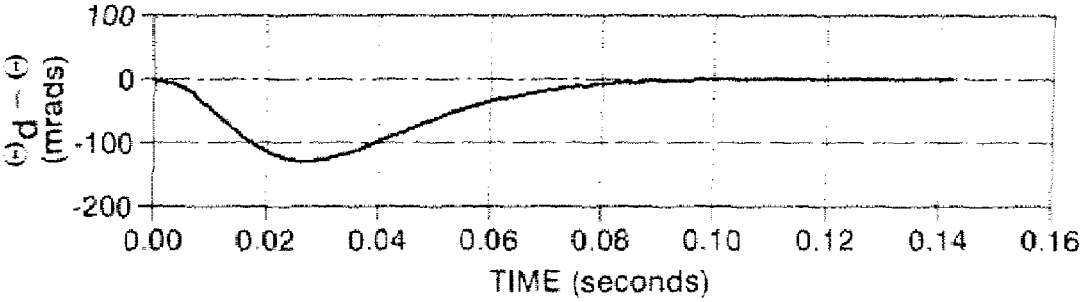

FIG. 10 depicts a graph of the output error for the virtual cart. As shown in FIG. 10, the cart outputs asymptotically converged to the desired values via the input-output linearization process. Moreover, this convergence occurred within approximately 100 ms, which is substantially less than the 142.5 ms limit based on the system constraints. The convergence of the cart outputs may guarantee the convergence of the can states as depicted in FIGS. 11A-C, which depict graphs of the error for the X, Y and Θ states for the cart, respectively. In the results depicted in FIGS. 11A-C, the Y and Θ states converged approximately 10 ms later than the X state. The delay for the Y and Θ states may be largely attributed to the time that it takes $P_c$ to converge to the desired trajectory after $P_b$ has converged.

Figure 12A:
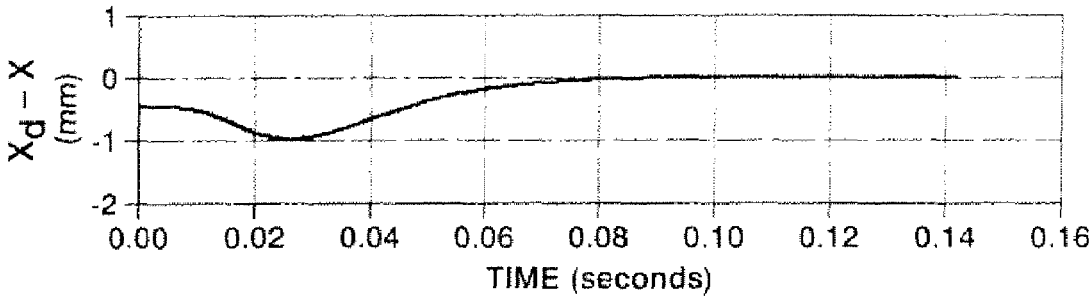
FIGS. 12A-C depict graphs of the error for the x, y, and θ states for the sheet in an exemplary embodiment, respectively.
Figure 12B:
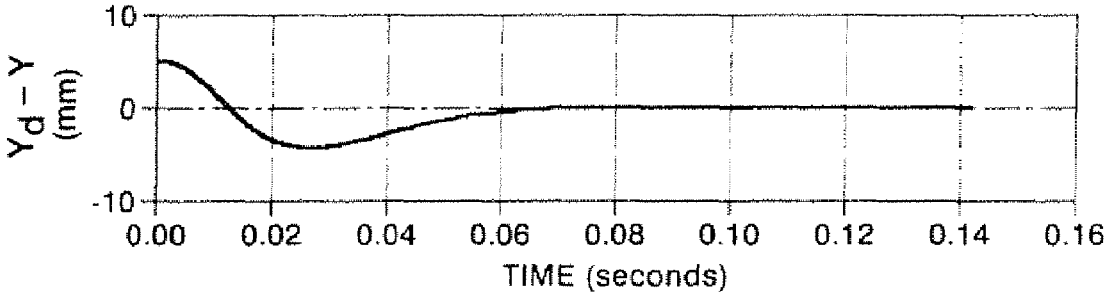
Figure 12C:
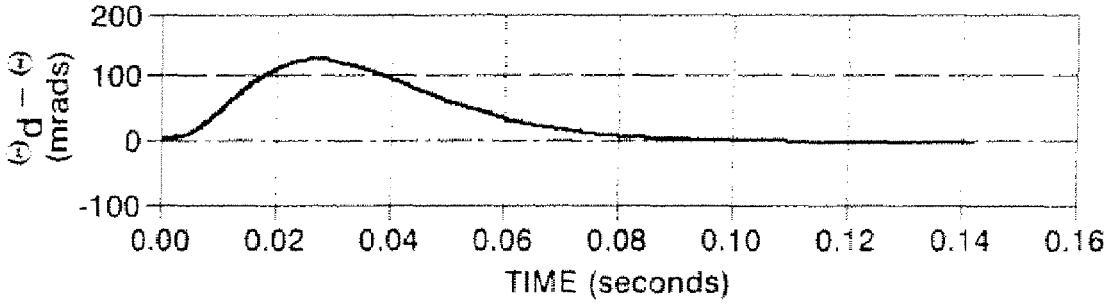

FIGS. 12A-C depict graphs of the error for the x, y, and θ states for the sheets respectively. The graphs depicted in FIGS. 12A-C were generated by transforming the cart states to the sheet states via the equations defined above. Again, the convergence of the sheet occurs within approximately 100 ms.

Figure 13:
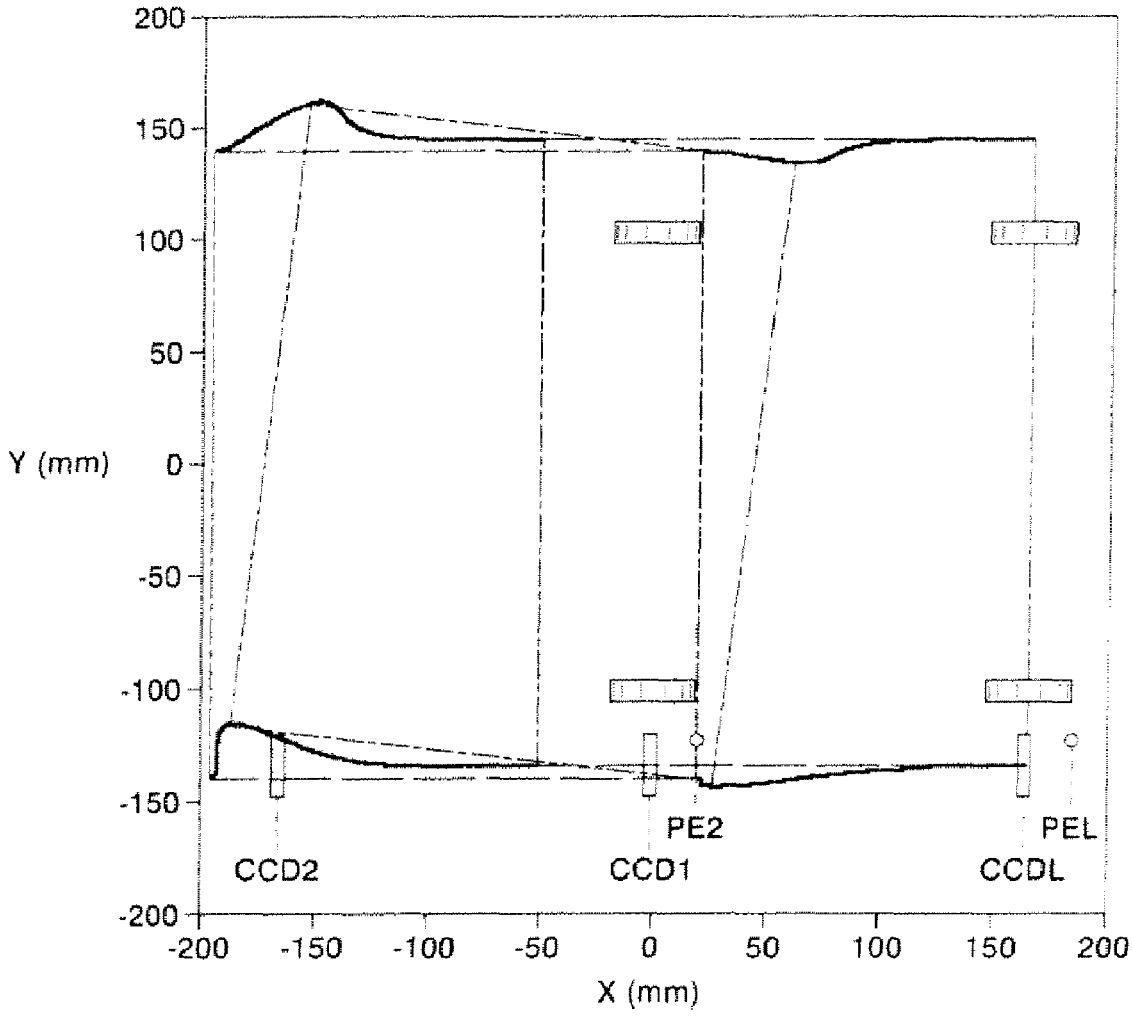
FIG. 13 depicts a graph of the sheet position as it traverses through a sheet registration system in an exemplary embodiment.

FIG. 13 depicts a graph of the sheet position as it moved through the sheet registration system. As shown in FIG. 13, the sheet's corners are plotted as the sheet passes through the sheet registration system (from left to right). FIG. 13 depicts the outline of the sheet for three sample periods during the registration process. The first sample period is the input position snapshot. The CCD sensors, the process edge (PE) sensors and the drive rolls are included in FIG. 13 to provide a frame of reference for the sheet position. The drive rolls are also included to show that the paper is registered before entering the pre-transfer nip.

The numerical results for the sheet state error are depicted in Table 1.

TABLE 1

| | $x_d - x$ | $y_d - y$ | $\theta_d - \theta$ |
|---|---|---|---|
| Input state error | −0.500 mm | 5.00 mm | 5.00 mrad |
| Output state error | −0.00027 mm | 0.00361 mm | 0.05322 mrad |

What is claimed is:

1. A method of performing sheet registration, the method comprising:

identifying output values for a sheet within a reference frame;

determining a difference between each output value and a corresponding desired output value;

determining input values for the sheet based on at least the differences;

determining state feedback values based on information received from one or more sensors; and for each of a plurality of drive rolls:

determining a jerk value based on the input values and the state feedback values via a processor, determining a desired angular velocity value based on the jerk value, and determining a motor voltage for a motor for the drive roll that tracks an observed angular velocity value for the drive roll to the desired angular velocity value for the drive roll, wherein the jerk values create a linear differential relationship between the input values and the output values, wherein the above-listed steps are performed a plurality of times.

2. The method of claim 1 wherein the output values correspond to a two-dimensional position within the reference frame.

3. The method of claim 1 wherein the reference frame is based on the location of the drive rolls.

4. The method of claim 3 wherein the desired output values correspond to a position of a point that is on a line bisecting the drive rolls.

5. The method of claim 1 wherein the input values are further determined based on at least one of the following:

a maximum force to be applied to a sheet by a drive roll;

a maximum amount of rotational velocity to apply to the sheet;

a maximum sheet registration time; and an output velocity for the sheet.

6. The method of claim 1 wherein the state feedback values comprise a two-dimensional position of the sheet within the reference frame and an angle at which the sheet is oriented with respect to a process direction.

7. A system for performing sheet registration, the system comprising:

one or more sensors;

a plurality of drive rolls;

a plurality of motors, wherein each motor is associated with at least one drive roll; and a processor, wherein the processor comprises:

a state feedback determination module configured to determine state feedback values based on information received from the one or more sensors, an output value identification module configured to determine output values based on the state feedback values, a difference generation module configured to determine the difference between each output value and a desired value for each output value, an input value determination module configured to determine input values based on at least the differences, a jerk value determination module configured to determine a jerk value for each drive roll based on the input values and the state feedback values, an angular velocity determination module configured to determine a desired angular velocity value for each drive roll based on the jerk value for the drive roll, and a motor voltage determination module configured to determine a motor voltage for each motor, wherein the motor voltage determination module tracks an observed angular velocity value for each drive roll to the desired angular velocity value for the drive roll, wherein the jerk values create a linear differential relationship between the input values and the output values.

8. The system of claim 7 wherein the output values correspond to a two-dimensional position within the reference frame.

9. The system of claim 7 wherein the reference frame is based on the location of the drive rolls.

10. The system of claim 9 wherein the desired output values correspond to a position of a point that is on a line bisecting the drive rolls.

11. The system of claim 7 wherein the input value determination module is further configured to determine the input values based on at least one of the following:

a maximum force to be applied to a sheet by a drive roll;

a maximum amount of rotational velocity to apply to the sheet;

a maximum sheet registration time; and an output velocity for the sheet.

12. The system of claim 7 wherein the state feedback values comprise a two-dimensional position of the sheet within the reference frame and an angle at which the sheet is oriented with respect to a process direction.

* * * * *